US005182834A

United States Patent [19]

Wright et al.

[11] Patent Number: 5,182,834

[45] Date of Patent: Feb. 2, 1993

[54] VACUUM PUMP-OUT CONTROL VALVE FOR WET/DRY VACUUM CLEANER

[75] Inventors: William R. Wright; Dexter Lehman, both of Elkhart, Ind.

[73] Assignee: White Consolidated Industries, Inc., Cleveland, Ohio

[21] Appl. No.: 869,387

[22] Filed: Apr. 16, 1992

[51] Int. Cl.[5] ..... A47L 5/14; A47L 7/00

[52] U.S. Cl. ..... 15/330; 15/353; 55/216; 55/431; 137/206; 417/315

[58] Field of Search ..... 15/330, 353; 55/216, 55/431, 467; 137/206; 417/315

[56] References Cited

U.S. PATENT DOCUMENTS

| | | | |
|---|---|---|---|
| 2,049,603 | 8/1936 | Dietenberger | 15/330 |
| 2,623,234 | 12/1952 | Brown | 15/330 |
| 2,643,732 | 6/1953 | Keen | 55/216 |
| 3,238,556 | 3/1966 | Martin | 15/330 |
| 3,331,090 | 7/1967 | Reiber | 15/321 |
| 3,343,199 | 9/1967 | Nolte | 15/330 X |
| 3,605,786 | 9/1992 | Machin | 137/205 |
| 4,116,211 | 9/1978 | Richardson | 137/205 |
| 4,171,208 | 10/1979 | Lowder | 55/216 |
| 4,179,768 | 12/1979 | Sawyer | 15/353 X |
| 4,443,235 | 4/1984 | Brenholt et al. | 55/218 |
| 4,841,595 | 6/1989 | Wiese | 15/353 X |
| 4,915,132 | 4/1990 | Hodge et al. | 137/599 X |
| 4,936,348 | 6/1990 | Swanson et al. | 137/625.46 |

*Primary Examiner*—Chris K. Moore

*Attorney, Agent, or Firm*—Pearne, Gordon, McCoy & Granger

[57] ABSTRACT

A pump-out control valve for use in connection with a wet/dry vacuum cleaner that includes a collection tank, a top cover and a vacuum blower with an air inlet and air outlet. The control valve is mounted over a pair of openings formed through the cover. The valve includes a manifold plate located over the pair of openings and spaced above the cover, and a valve rotor located between the manifold plate and the cover. The plate is provided with an air inlet fitting and an air outlet fitting that are connected through flexible hoses to the centrifugal blower. The fittings are in general alignment with the openings in the cover. The rotor has one through passage for connecting the manifold plate inlet with one of the openings through the cover and one lateral passage which is adapted to divert flow laterally and at the same time, block the other opening in the cover. The rotor is turned approximately 180° between two positions for either causing a vacuum in the tank or for pressurizing the tank for pumping out the liquid accumulation.

6 Claims, 4 Drawing Sheets

VACUUM PUMP-OUT CONTROL VALVE FOR WET/DRY VACUUM CLEANER

BACKGROUND OF THE INVENTION

This invention relates to portable vacuum cleaners, and especially to the type referred to as "wet/dry" vacuum cleaners, which are capable of picking up not only solid matter, such as dust, dirt and other dry debris, but also liquid or semi-liquid material. More particularly, the invention relates to wet/dry vacuum cleaners that are capable of pumping out the liquid solution in the tank in order to empty the recovered solution. The invention provides a valve for controlling the blower system in such a way that the exhaust air can be redirected back into the tank to apply pressure and pump the solution in the tank out through a tube that extends from the vacuum hose inlet to the bottom of the tank.

Wet/dry vacuum cleaners are used for a variety of purposes, such as the extraction of liquid used in the cleaning of floors, carpets, upholstery, etc. In these vacuum units, the liquid is sucked into a tank through a vacuum hose and it accumulates progressively in the collection tank during the operation. The dumping of the dirty liquid with its accumulated dirt and debris poses a problem since in many cases, the cover of the cleaner must be removed and the tank manually lifted and tilted on a sink or basin in order to dump the liquid solution. In other cases, the wet/dry vacuum cleaner is provided with a separate pump for evacuating the liquid solution. This is more costly to produce and requires additional maintenance.

In some current models, the dirty liquid is pumped out by reversing the connections for the vacuum blower in such a way that instead of exhausting air from the collection chamber in order to create a vacuum, exhaust air which normally exits through an exhaust fitting on the blower is applied to the tank so as to force the dirty solution through a tube that extends to a position close to the bottom of the tank. In this way, the liquid in the tank is pumped out through the inlet fitting for the vacuum system.

It is among the objects of the present invention to provide a vacuum pump-out control valve for a wet/dry vacuum cleaner that permits pressure from the vacuum blower to be applied to the liquid-filled collection tank.

Another object of the invention is to provide a unique rotating valve in a vacuum pump-out system for a wet/dry vacuum cleaner that may be easily switched back and forth between a normal, vacuum position and a pressure applying, pump-out position.

SUMMARY OF THE INVENTION

These and other objects and advantages are achieved with the unique vacuum pump-out control valve of the present invention. The basic wet/dry components of the vacuum cleaner in which the present invention is utilized include a collection tank, a cover closing the top of the tank and a vacuum blower with an air inlet and an air outlet.

In accordance with the invention, the system is provided with a flow control valve which includes means defining a pair of openings through the cover on opposite sides of a central axis that is perpendicular to the cover. The valve includes a manifold plate located over the pair of openings and spaced above the cover. The plate has an air inlet fitting communicating through a hose or the like with the air outlet for the vacuum blower and an air outlet fitting also communicating through a flexible hose or the like with the air inlet to the vacuum blower. The fittings are so located as to be in general alignment with the openings in the cover.

Located between the manifold plate and the cover is a valve rotor. The rotor is adapted for rotation about the previously described central axis through an arc of about 180° between a pressure position and a vacuum position. The rotor has one through passage formed therein for connecting the manifold plate outlet with one of the openings through the cover when the rotor is in its vacuum position to cause a vacuum in the tank. Also, the passage is adapted to connect the manifold plate inlet with the other opening in the cover when the rotor is in its pressure position to cause a pressurizing of the tank.

The rotor is adapted to close one of the openings in the cover in each of its positions, depending on the condition selected. The rotor is turned between its two positions by means of a rotor stem and an external control knob adapted for manual operation. The manifold plate and rotor are provided with cooperating stop means to positively stop the rotor in its two limit positions.

DESCRIPTION OF THE PREFERRED EMBODIMENT

Figure 1:
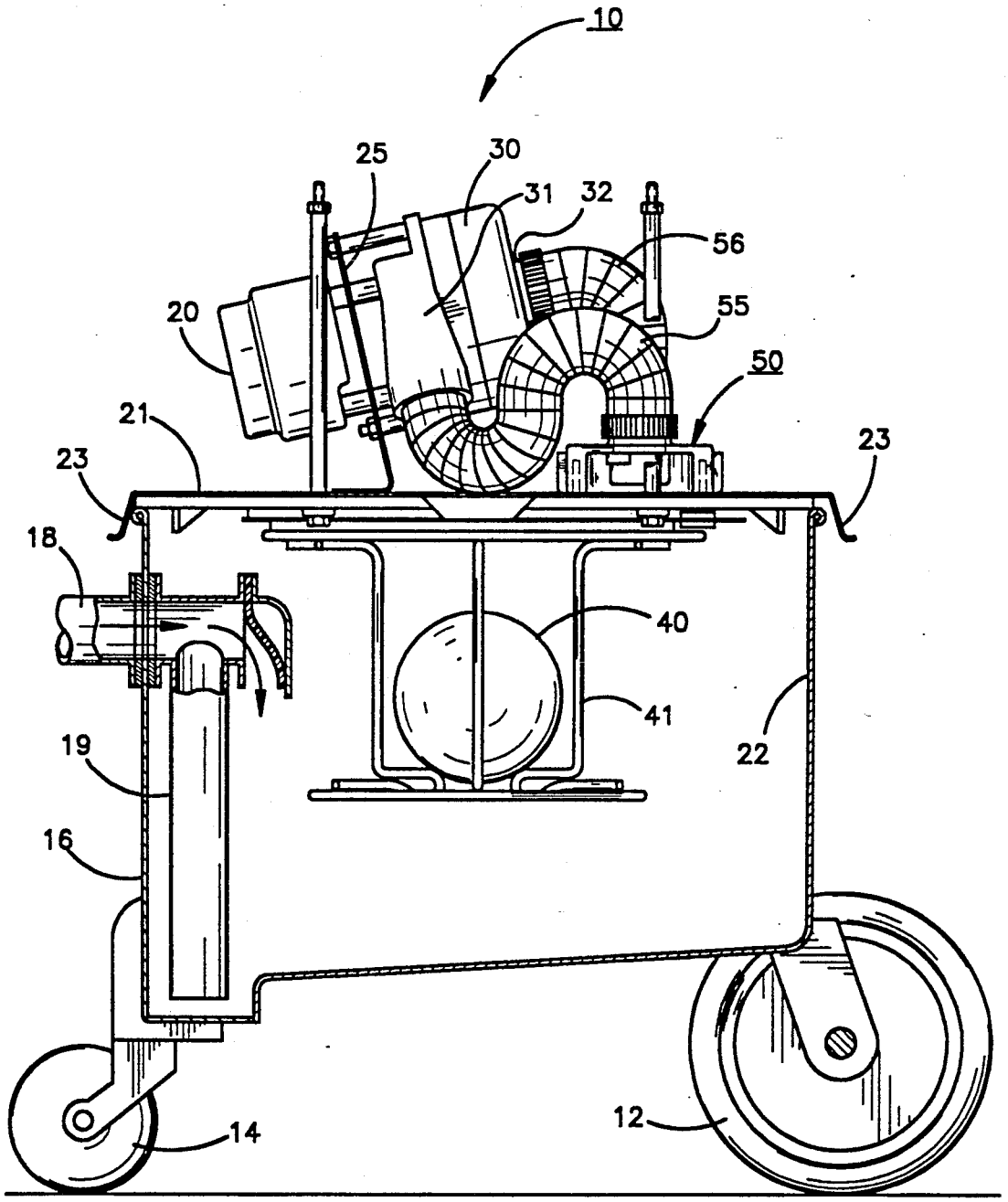
FIG. 1 is an elevational view of a wet/dry vacuum cleaner unit embodying the invention with parts broken away and shown in section for the purpose of illustration.
Figure 2:
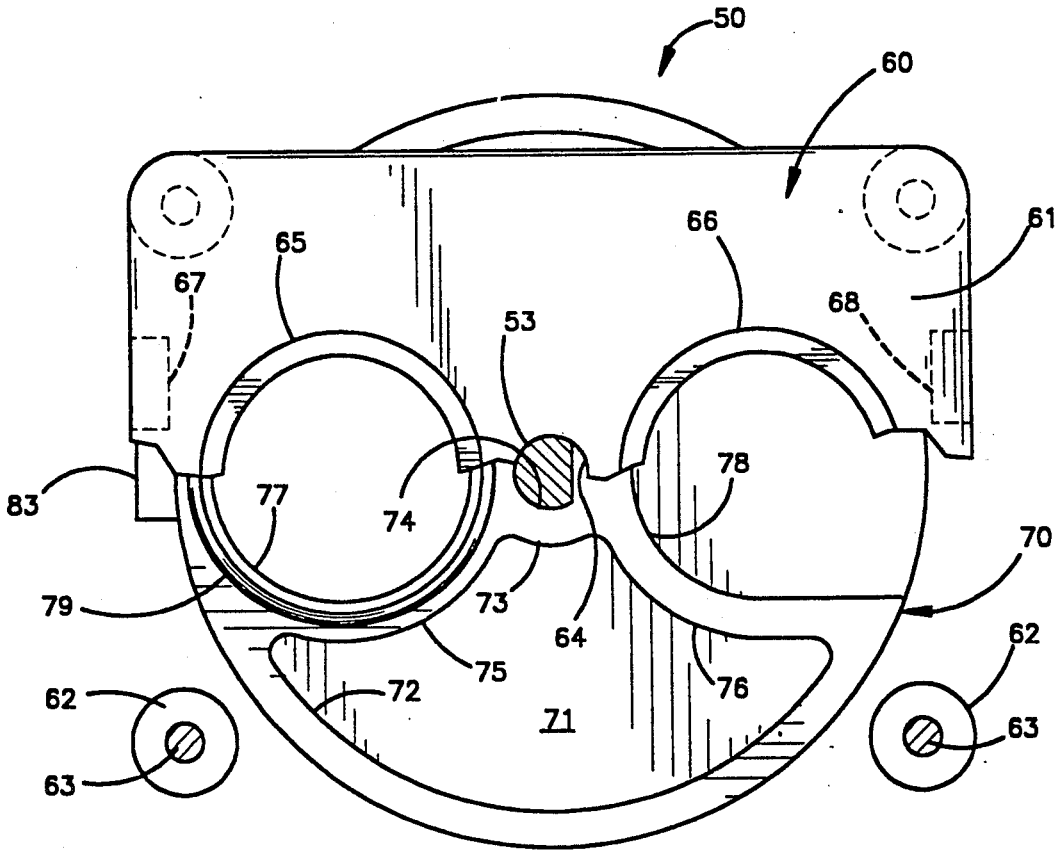
FIG. 2 is a plan view on an enlarged scale showing the pump-out control valve in its normal position with parts broken away and shown in section for the purpose of illustration.
Figure 3:
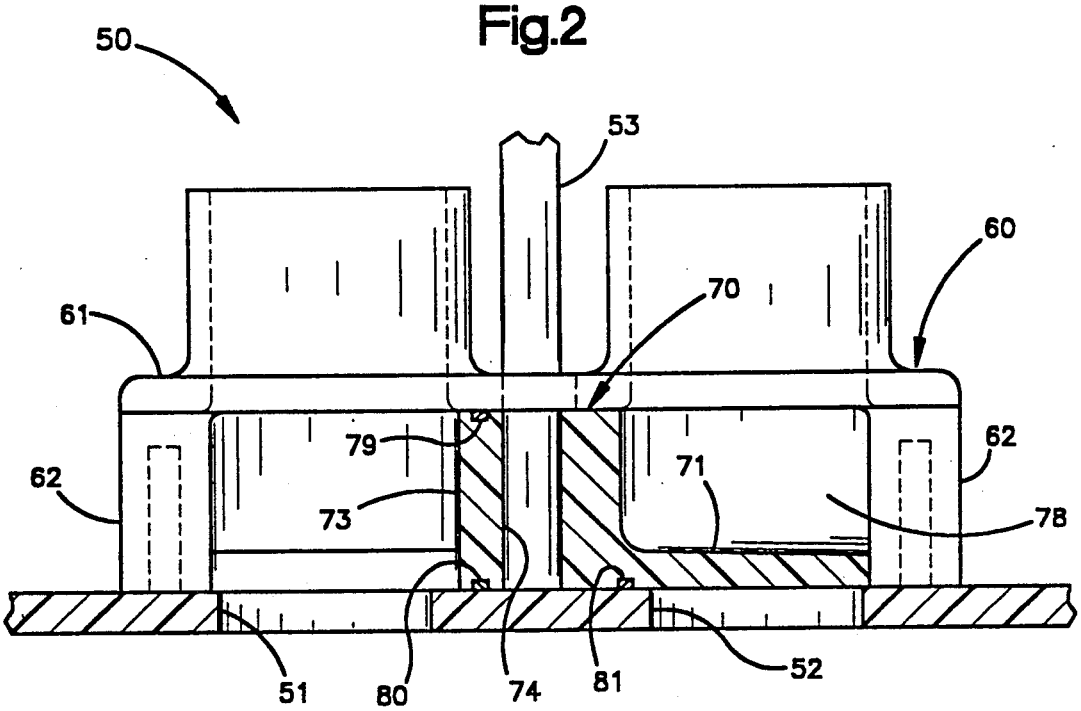
FIG. 3 is an elevational view illustrating the valve in the same position as in FIG. 2 and with parts broken away and shown in section for the purpose of illustration.
Figure 4:
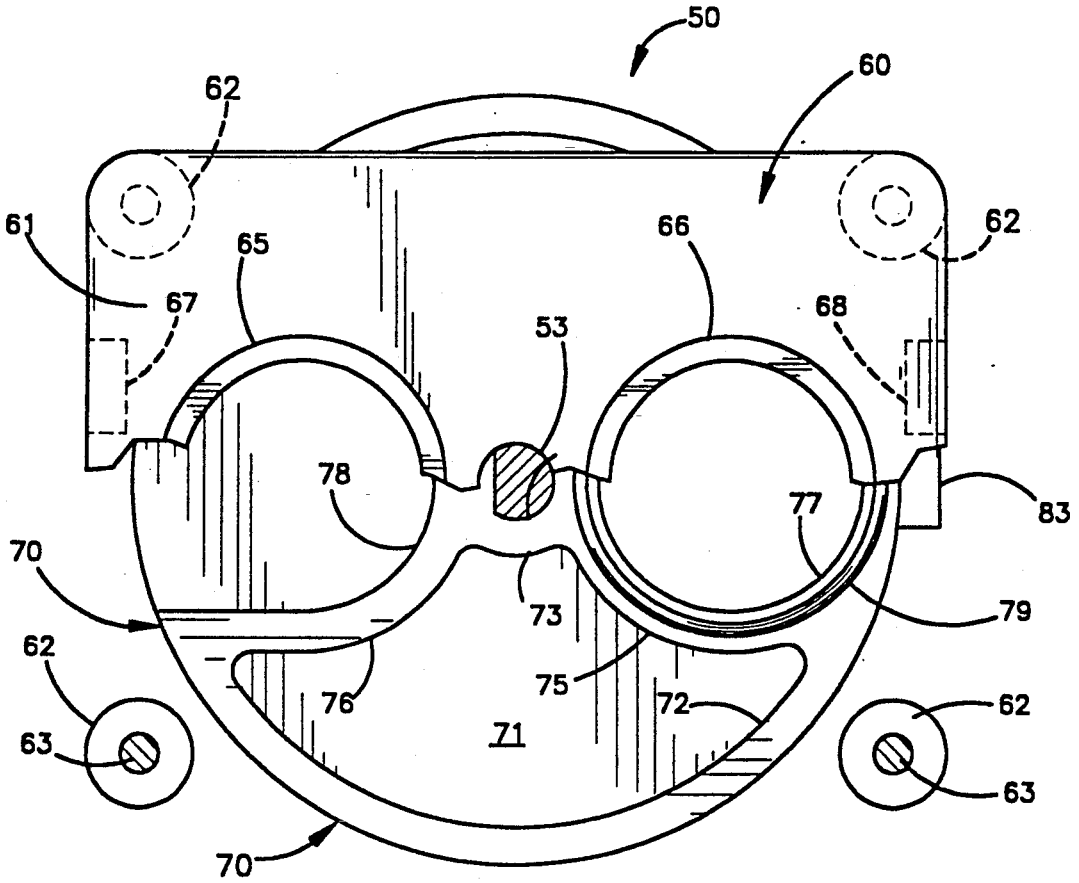
FIG. 4 is a plan view similar to FIG. 2, but showing the valve rotor rotated through an arc of 180° to its pressure applying position with parts broken away and shown in section for the purpose of illustration.
Figure 5:
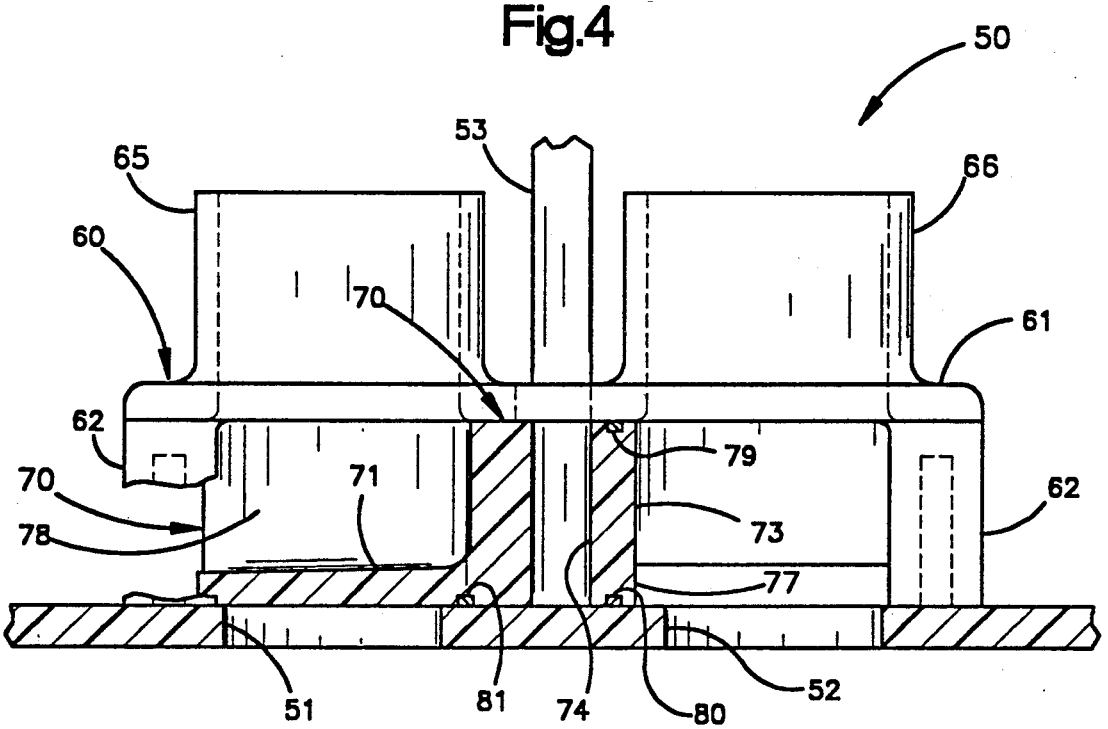
FIG. 5 is an elevational view illustrating the valve in the same position as in FIG. 4, with parts broken away and shown in section for the purpose of illustration.
Figure 6:
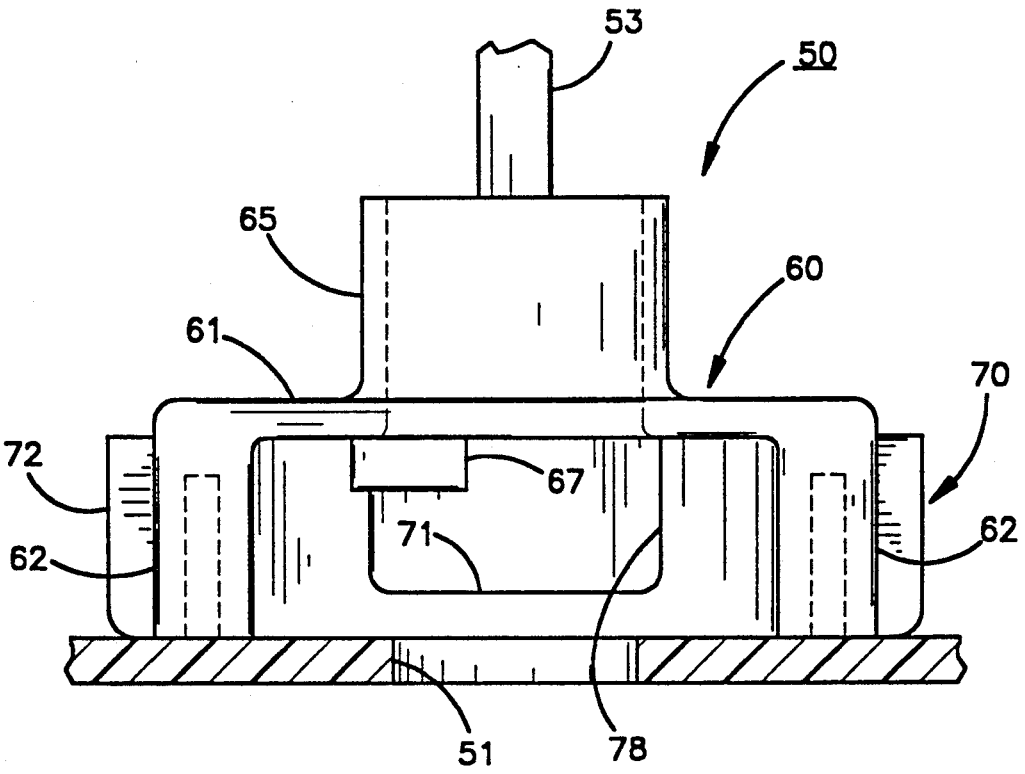
FIG. 6 is an end elevational view of the pump-out control valve showing the rotor in the same position as in FIGS. 4 and 5.

Referring more particularly to the drawings and initially to FIGS. 1 and 2, there is shown a wet/dry vacuum cleaner referred to generally by the numeral 10 and which has a control valve 50 embodying the invention for use in pumping out accumulated liquid from the collection tank. The unit has a pair of wheels 12 and at least one caster 14 so that it may easily be moved to a desired location.

The unit further includes as conventional components, a liquid collection tank 16 carried by the wheels and casters and provided with an air and liquid socket 18. The socket is intended to permit connection thereto of a vacuum hose with a suction head (not shown) used to draw dirt, debris and liquid into the collection tank. A pump-out tube 19 extends vertically within the tank 16 and is connected to the conduit that communicates with the socket 18. The bottom of the tank 16 is sloped so as to form a sump into which the pump-out tube 19 extends.

An electrical blower motor 20 is mounted on a relatively flat tank cover 21 adapted to fit over the rim of the collection tank 16. The tank is round and has a cylindrical side wall 22 with upper edges lying in a plane and adapted to receive the cover 21. The cover 21 has a downwardly extending flange 23 which fits over the upper edges of the side wall 22 of the tank 16. A specially shaped motor cover 24 is positioned over the top of the motor and secured to the tank cover 21.

The motor 20 drives a centrifugal vacuum blower 30 which is supported by the tank cover 21 and which is mounted at a tilting angle by means of a bracket 25. The blower 30 has a tangential outlet 31 and an axial inlet 32 and the control of the flow from the inlet and outlet is controlled by means of a pump-out control valve 50 embodying the invention.

Located below the cover 21 is a spherical float 40 that is supported in a cage 41 that extends into the upper area of the collection tank. The cage is secured to the bottom of the tank cover 21. The purpose of the spherical float 40 is to prevent suction from being applied by the blower motor 20 when the height of the liquid recovered in the collection tank reaches a predetermined level. When this condition occurs, the vacuum mode of the unit is automatically shut down.

Referring to FIGS. 2–6, the control valve 50 is adapted to selectively connect one of a pair of holes 51 and 52 (FIGS. 2 and 4) formed in the tank cover 21. The holes are located on opposite sides of the axis of symmetry for the valve 50 which also serves as the axis of a rotor stem 53 which is adapted to operate the valve and which has a control knob 54 on the top for manual operation. The stem 53 extends through the motor cover 24 so that the valve may be operated manually at a convenient location.

An exhaust hose 55 extends from the tangential blower outlet 31 to the valve and another hose 56 extends from the axial inlet 32 to the valve.

The valve 50 includes as its basic components, a manifold 60 and a rotor 70. The manifold 60 has a top plate 61 spaced above the tank cover 21 by means of legs 62. The legs 62 are connected to the tank cover 21 by bolts 63. Also, a circular opening 64 is formed in the center of the top plate 61 through which the stem 53 extends.

A pair of hose sockets 65 and 66 are formed in the top of the manifold plate 61 on opposite sides of the hole 64 and ar adapted to receive the hoses 55 and 56, respectively. Also, stop lugs 67 and 68 are located on opposite ends of the top plate 61 and extend downwardly to cooperate with the rotor for providing limit positions as will be described below.

The rotor 70 is of generally cylindrical form and is preferably molded from suitable plastic material. The rotor has a generally circular floor 71 and a cylindrical side wall 72 so that an internal cavity is provided. At the center of the cavity a generally cylindrical wall 73 is formed with a central opening 74 adapted to receive the stem 53. The hole is generally circular but has a flat portion that engages a cooperating flat formed on the stem.

Located on opposite sides of the wall 73 are upright cylindrical walls 75 and 76. The wall 75 defines an axial through passage 77 and the wall 76 defines a lateral passage 78. The through passage 77 extends through the floor 71 and upper and lower seal rings 79 and 80 are received in annular grooves in the floor and at the top of the wall 75 to provide a seal between the top surface of the cover 21 on the one hand and the bottom surface of the manifold top plate 61. The lateral passage 78 opens laterally through an opening in the cylindrical side wall 72 of the rotor so that it communicates with the rotor chamber.

A radial stop lug 83 extends outwardly from the cylindrical wall 72 adjacent the top thereof and is adapted to engage the stop lugs 67 and 68 that extend downwardly from the top plate 61 of the manifold so as to provide limit positions at the ends of the range of rotary movement of the rotor 70. Accordingly, the rotor has two positions in one of which the through passage 77 provides a conduit from the socket 65 through the rotor and through the opening 51 in the cover. At the same time, the lateral passage 78 defines a flow channel from the socket 66 and laterally outward through the opening in the rotor side wall. The opening 52 is sealed by the floor 71.

With the rotor in its other limit position, the through passage 77 provides a conduit from the socket 66 through the hole 52 in the cover and thus into the collection chamber. At the same time, the lateral passage 78 defines a conduit from the socket 65 laterally through the cylindrical side wall 72 of the rotor 70. The opening 51 is sealed by the floor 71.

OPERATION

The valve arrangement thus described enables an operator to easily switch the vacuum system back and forth between a vacuum position (FIGS. 2 and 3) wherein the centrifugal blower 30 draws air from the collection tank 16 through the opening 51 and thus creates a vacuum. This produces a suction so that debris, liquid, etc. may be drawn through a vacuum head into the collection tank.

Then when the valve 50 is rotated using the handle 54 to the pump-out position (FIGS. 3 and 4), pressure is applied from the centrifugal blower 30 through the valve 50 and into the collection tank 16 through the opening 52 to force liquid in the tank outwardly through the pump-out tube 19.

While the invention has been shown and described with respect to a specific embodiment thereof, this is intended for the purpose of illustration rather than limitation and other modifications and variations of the specific device herein shown and described will be apparent to those skilled in the art, all within the intended spirit and scope of the invention. Accordingly, the patent is not to be limited in scope and effect to the specific embodiment herein shown and described, nor in any other way that is inconsistent with the extent to which the progress in the art has been advanced by the invention.

What is claimed is:

1. In a wet/dry vacuum system including a collection tank, a cover closing the top of the tank and a blower having an air inlet and an air outlet:

a flow control valve which comprises:

means defining a pair of openings through said cover on opposite sides of a central axis perpendicular to said cover;

a manifold plate located over said pair of openings and spaced from said cover, said plate having an air inlet fitting communicating with said blower motor air inlet and an air outlet fitting, communicating with said blower air outlet, said inlet and outlet fittings being in alignment with said openings in said cover;

a valve rotor located between said manifold plate and said cover and adapted for rotation about said axis between a pressure position and a vacuum position;

passage means formed in said rotor for connecting said manifold plate inlet and one of said openings in said cover and closing the other of said openings when said rotor is in its vacuum position to cause a vacuum in said tank and for connecting said manifold plate outlet with the other opening in said cover and closing said one of said openings when said rotor is in its pressure position to cause a pressurizing of said tank.

2. A flow control valve as defined in claim 1 including means connected to said rotor at its axis for manually rotating said rotor between its pressure position and its vacuum position.

3. A flow control valve as defined in claim 1 wherein said rotor rotates about 180° between its pressure position and its vacuum position.

4. A flow control valve as defined in claim 3 including stop means for limiting rotary movement of said rotor in both directions to its pressure position and its vacuum position.

5. A flow control valve as defined in claim 4 wherein said stop means comprises a pair of fixed stop lugs extending downwardly from said manifold plate on opposite sides thereof and a radially outwardly extending stop lug on said rotor adapted to engage one of said fixed lugs when in its pressure position and the other when in its vacuum position.

6. A flow control valve as defined in claim 1 wherein said rotor vents said air inlet fitting to space external to said tank when said rotor is in its pressure position and vents said air outlet fitting to said external space when said rotor is in its vacuum position.

* * * * *

UNITED STATES PATENT AND TRADEMARK OFFICE

CERTIFICATE OF CORRECTION

PATENT NO. : 5,182,834
DATED : February 2, 1993
INVENTOR(S) : William R. Wright, et. al.

It is certified that error appears in the above-indentified patent and that said Letters Patent is hereby corrected as shown below:

Column 3, line 51, delete "ar" and insert --are--.

Column 4, line 7, delete "rotor" and insert --motor--.

Signed and Sealed this

Twenty-second Day of February, 1994

*Attest:*

Bruce Lehman

BRUCE LEHMAN

*Attesting Officer*

*Commissioner of Patents and Trademarks*